US009101028B2

(12) United States Patent
Isaacson et al.

(10) Patent No.: US 9,101,028 B2
(45) Date of Patent: Aug. 4, 2015

(54) POWERING AND/OR CONTROLLING LEDS USING A NETWORK INFRASTRUCTURE

(71) Applicant: NuLEDs, Inc., Vista, CA (US)

(72) Inventors: Chris A. Isaacson, Encinitas, CA (US); Peter Verkaik, Heemstede (NL)

(73) Assignee: NuLEDs, Inc., Carlsbad, CA (US)

( * ) Notice: Subject to any disclaimer, the term of this patent is extended or adjusted under 35 U.S.C. 154(b) by 0 days.

(21) Appl. No.: 13/747,399

(22) Filed: Jan. 22, 2013

(65) Prior Publication Data

US 2013/0193873 A1 Aug. 1, 2013

Related U.S. Application Data

(60) Provisional application No. 61/589,788, filed on Jan. 23, 2012.

(51) Int. Cl.
*H05B 37/02* (2006.01)
*H05B 33/08* (2006.01)

(52) U.S. Cl.
CPC ..... *H05B 33/0857* (2013.01); *H05B 37/0254* (2013.01)

(58) Field of Classification Search
CPC ..... H05H 37/254
USPC ..... 315/294
See application file for complete search history.

(56) References Cited

U.S. PATENT DOCUMENTS

| | | | | |
|---|---|---|---|---|
| 5,621,283 | A * | 4/1997 | Watson et al. | 315/362 |
| 6,016,038 | A | 1/2000 | Mueller | |
| 6,150,774 | A * | 11/2000 | Mueller et al. | 315/291 |
| 7,274,160 | B2 * | 9/2007 | Mueller et al. | 315/312 |
| 7,394,210 | B2 * | 7/2008 | Ashdown | 315/291 |
| 7,982,335 | B2 * | 7/2011 | Aldag et al. | 307/12 |
| 8,011,794 | B1 * | 9/2011 | Sivertsen | 362/85 |
| 8,174,212 | B2 * | 5/2012 | Tziony et al. | 315/309 |
| 8,386,832 | B2 * | 2/2013 | Karam et al. | 714/4.11 |
| 8,390,441 | B2 * | 3/2013 | Covaro et al. | 340/538 |
| 8,390,467 | B2 * | 3/2013 | Feldstein et al. | 340/654 |
| 8,398,253 | B2 * | 3/2013 | Sivertsen | 362/85 |
| 2002/0145394 | A1 | 10/2002 | Morgan et al. | |
| 2008/0054390 | A1 | 3/2008 | Sloan | |
| 2008/0164827 | A1 | 7/2008 | Lys | |
| 2011/0273108 | A1 * | 11/2011 | Sivertsen | 315/250 |

FOREIGN PATENT DOCUMENTS

| | | |
|---|---|---|
| KR | 10-1008509 | 1/2011 |

* cited by examiner

*Primary Examiner* — Douglas W Owens
*Assistant Examiner* — Srinivas Sathiraju
(74) *Attorney, Agent, or Firm* — Robroy R. Fawcett

(57) ABSTRACT

The subject matter disclosed herein provides methods and apparatus, including computer program products, for controlling and power lighting units connected to a network controller. In one aspect there is provided a method that may include receiving at a first input power from a power supply; receiving at a second input one or more illumination control packets from a data processing device via one or more network connections; transmitting from a first output power to one or more lighting units; and powering from a second output an illumination level of one or more colors associated with the one or more lighting units in accordance with the one or more illumination control packets via the one or more network connections. Related apparatus, systems, techniques and articles are also described.

18 Claims, 9 Drawing Sheets

A12R255G255B140F100

A12 ⟶ Address = 12
R255 ⟶ Red level value = 255
G255 ⟶ Green level value 255
B140 ⟶ Blue level value = 140
F100 ⟶ Fade time = 100 (1/10 seconds)

400

| 410 | 420 | 430 | 440 | 450 | 460 | 470 |
|---|---|---|---|---|---|---|
| SEQ # | Red Level | Green Level | Blue Level | Fade Time | Hold Time | Color Description |
| 1 | 255 | 255 | 255 | 1 | 2 | Ice Cool White |
| 2 | 255 | 255 | 150 | 1 | 2 | White |
| 3 | 255 | 255 | 110 | 1 | 2 | Warm White |
| 4 | 255 | 255 | 70 | 1 | 2 | Ultra Warm White |
| 5 | 255 | 255 | 0 | 3 | 3 | Yellow |
| 6 | 127 | 255 | 0 | 3 | 3 | Yellowish Green |
| 7 | 0 | 255 | 0 | 3 | 3 | Green |
| 8 | 0 | 255 | 127 | 3 | 3 | Bluish Green |
| 9 | 0 | 255 | 255 | 3 | 3 | Cyan |
| 10 | 0 | 127 | 255 | 3 | 3 | Greenish Blue |
| 11 | 0 | 0 | 255 | 3 | 3 | Blue |
| 12 | 127 | 0 | 255 | 3 | 3 | Purple |
| 13 | 255 | 0 | 255 | 3 | 3 | Fuscia |
| 14 | 255 | 0 | 127 | 3 | 3 | Hot Pink |
| 15 | 255 | 0 | 0 | 3 | 3 | Red |
| 16 | 255 | 127 | 0 | 3 | 3 | Orange |

*FIG. 4*

POWERING AND/OR CONTROLLING LEDS USING A NETWORK INFRASTRUCTURE

CROSS-REFERENCE TO RELATED APPLICATIONS

The current application claims priority under 35 U.S.C. §119(e) to U.S. Provisional Patent Application No. 61/589,788 filed on Jan. 23, 2012, the disclosure of which is incorporated herein by reference in its entirety for all purposes. The current application is related to U.S. patent application Ser. No. 12/872,890, filed Aug. 31, 2010, now issued as U.S. Pat. No. 8,344,641 on Jan. 1, 2013, which claims the benefit of U.S. Provisional Application No. 61/238,977, filed Sep. 1, 2009. Each application listed in this paragraph is incorporated herein by reference in their entirety for all purposes.

TECHNICAL FIELD

The subject matter described herein relates to light-emitting diode (LED) illumination control using a simple digital command structure, and in some implementations, to powering and controlling LED lighting utilizing one at least one of direct current (DC) power and power over Ethernet (PoE) power.

BACKGROUND

LED illumination control is often accomplished by the modification of existing illumination control systems largely developed for AC incandescent lamps or similar devices. Such systems can have relatively complicated command structures and modalities.

An example of an existing digital interface for illumination control system is the Digital Addressable Lighting Interface (DALI), which typically uses a two-byte command having an address byte and a control byte. The data rate is typically 1200 bits per second. The control byte can have one of 512 different values, each representing distinct operations. Such digital interfaces can require several commands to accomplish relatively simple LED illumination control.

SUMMARY

In some implementations, methods and apparatus, including computer program products, are provided for controlling and power lighting units connected to a network controller.

In some implementations, there is provided an apparatus. The apparatus can include a first input to receive power from a power supply connected to the apparatus; a second input to receive one or more illumination control packets from a data processing device connected to the apparatus via one or more network connections; a first output to transmit power to one or more lighting units connected to the apparatus; and a second output to power an illumination level of one or more colors associated with the one or more lighting units in accordance with the one or more illumination control packets via the one or more network connections.

The above apparatus may, in some implementations, further include one or more of the following features.

In some implementations, the one or more illumination control packets can specify at least one or more color level parameters and one or more scaling parameters.

In some implementations, the apparatus can further include a processor. This processor can be configured to control the one or more colors associated with the one or more lighting units by pulse modulating a signal in accordance with the one or more color level parameters and the one or more scaling parameters.

In still other implementations, the power supply connected to the apparatus can be a power over Ethernet device; the first input can receive power from the power supply via an Ethernet connection; and the first output can transmit power to the one or more lighting units via the Ethernet connection. In some implementations, the first input and the first output can be an RJ45 socket.

In yet other implementations, the first input can receive power from the power supply via low voltage wiring, and the first output can transmit power to the one or more lighting units via the low voltage wiring.

In some implementations, there is provided a method. This method can include receiving at a first input power from a power supply; receiving at a second input one or more illumination control packets from a data processing device via one or more network connections; transmitting from a first output power to one or more lighting units; and powering from a second output an illumination level of one or more colors associated with the one or more lighting units in accordance with the one or more illumination control packets via the one or more network connections.

The above method can, in some implementations, further include one or more of the following features.

In some implementations, the one or more illumination control packets can specify at least one or more color level parameters and one or more scaling parameters.

In some implementations, the method can further include controlling the one or more colors associated with the one or more lighting units by pulse modulating a signal in accordance with the one or more color level parameters and the one or more scaling parameters.

In still other implementations, the power supply can be a power over Ethernet device; power can be received at the first input from the power supply via an Ethernet connection, and power can be transmitted from the first output to the one or more lighting units via the Ethernet connection. In some implementations, the first input and the first output can be an RJ45 socket.

In yet other implementations, power can be received at the first input from the power supply via low voltage wiring, and power can be transmitted from the first output to the one or more lighting units via the low voltage wiring.

In some implementations, there is provided a non-transitory computer-readable medium. The non-transitory computer-readable medium can contain instructions to configure a processor to perform operations. These operations can include receiving at a first input power from a power supply; receiving at a second input one or more illumination control packets from a data processing device via one or more network connections; transmitting from a first output power to one or more lighting units; and powering from a second output an illumination level of one or more colors associated with the one or more lighting units in accordance with the one or more illumination control packets via the one or more network connections.

The above computer program product can, in some implementations, further include one or more of the following features.

In some implementations, the one or more illumination control packets can specify at least one or more color level parameters and one or more scaling parameters.

In some implementations, the operations can further include controlling the one or more colors associated with the one or more lighting units by pulse modulating a signal in accordance with the one or more color level parameters and the one or more scaling parameters.

In still other implementations, the power supply can be a power over Ethernet device; power can be received at the first input from the power supply via an Ethernet connection, and power can be transmitted from the first output to the one or more lighting units via the Ethernet connection. In some implementations, the first input and the first output can be an RJ45 socket.

In yet other implementations, power can be received at the first input from the power supply via low voltage wiring, and power can be transmitted from the first output to the one or more lighting units via the low voltage wiring.

It is to be understood that both the foregoing general description and the following detailed description are exemplary and explanatory only and are not restrictive. Further features and/or variations may be provided in addition to those set forth herein. For example, the implementations described herein may be directed to various combinations and subcombinations of the disclosed features and/or combinations and subcombinations of several further features disclosed below in the detailed description.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

FIG. 4 is a table of a pre-programmed illumination sequence consistent with implementations of the current subject matter;

FIGS. 5A, 5B, and 5C are a magnified view of FIG. 5;

When practical, similar reference numbers denote similar structures, features, or elements.

DETAILED DESCRIPTION

The details of one or more variations of the subject matter described herein are set forth in the accompanying drawings and the description below. Other features and advantages of the subject matter described herein will be apparent from the description and drawings.

Figure 1:
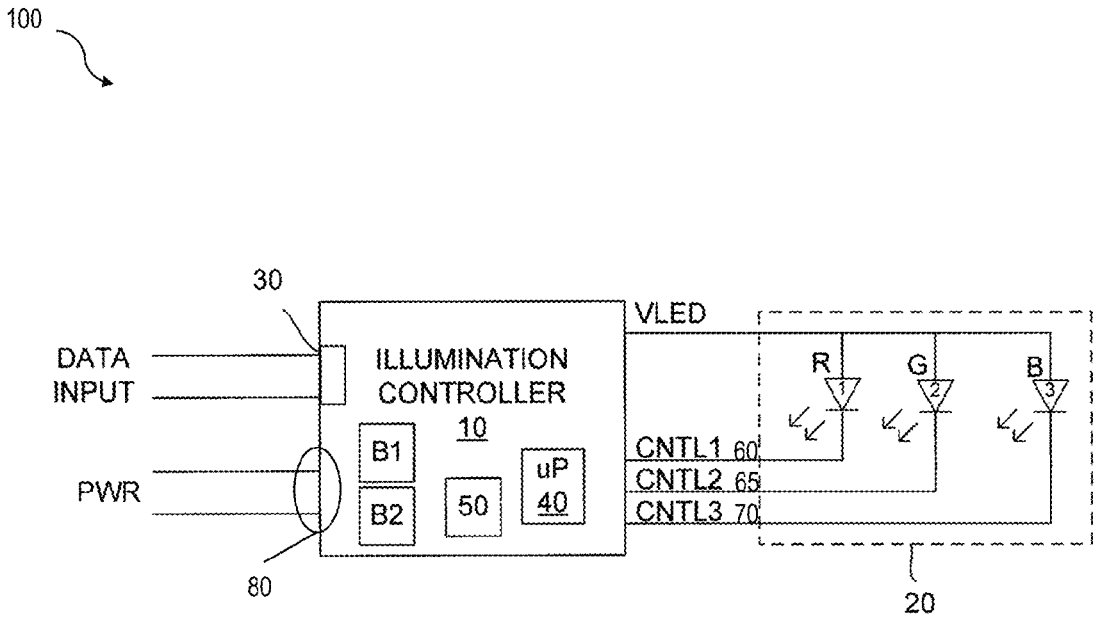
FIG. 1 is a schematic block diagram illustrating an illumination controller consistent with implementations of the current subject matter.
Figure 2:
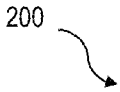
FIG. 2 is a schematic diagram illustrating a unitary illumination control command consistent with implementations of the current subject matter.
Figure 3:
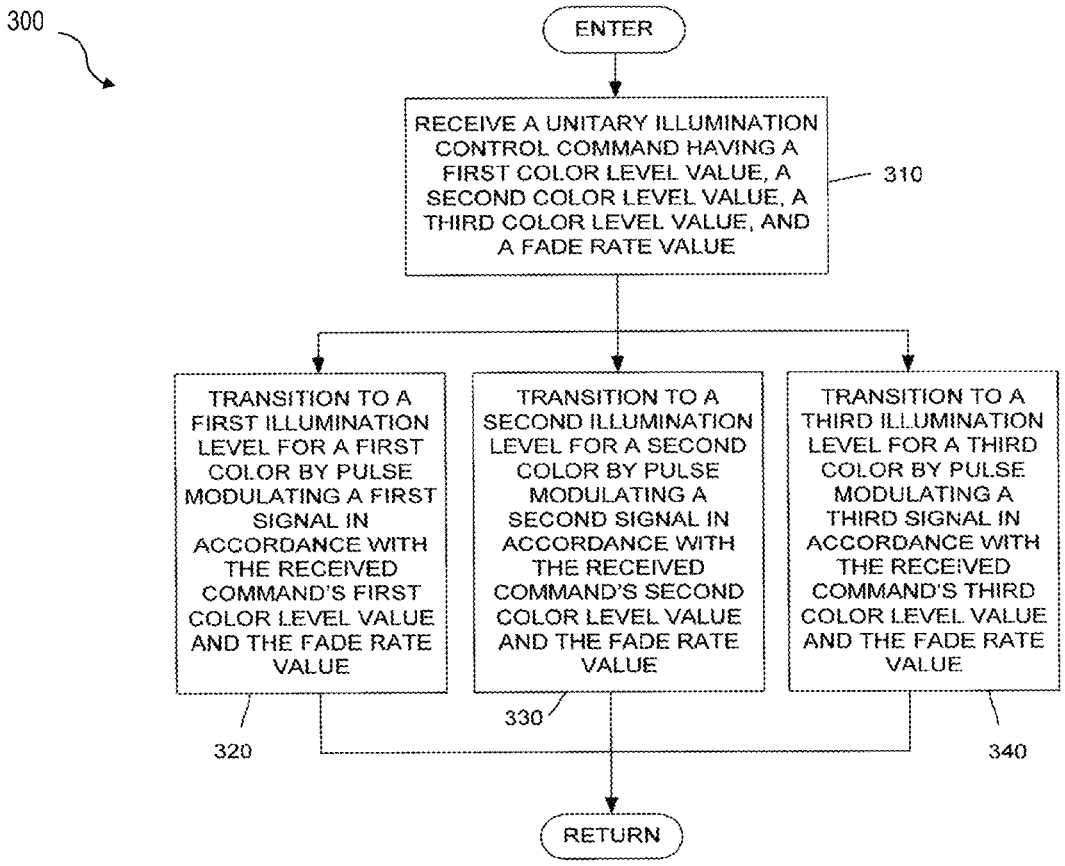
FIG. 3 is a flow diagram illustrating a method for three-color LED illumination control consistent with implementations of the current subject matter.

With reference to FIG. 1 to FIG. 3, an implementation of the current subject matter can include an illumination controller 10 (FIG. 1) for use with at least one three-color LED module 20. The illumination controller can include a command input, three (or more or less) color control outputs, CNTL1 60, CNTL2 65, and CNTL3 70, and a processor 40. The command input 30 receives at least one illumination control packet. The first color control output pulse modulates a first signal that powers a first illumination level for a first color. The second color control output pulse modulates a second signal that powers a second illumination level for a second color. The third color control output pulse modulates a third signal that powers a third illumination level for a third color. The processor controls the first color control output in accordance with a first color level parameter associated with a first illumination control packet received at the input and a scale parameter associated with a second illumination control packet received at the input, controls the second color control output in accordance with a second color level parameter associated with the first illumination control packet and the scale parameter; and controls the third color control output in accordance with the third color level parameter associated with the first illumination control packet and the scale parameter. The three colors can, in at least some variations, be red, green, and blue.

The first, second and third signals can in some variations have voltages of less than approximately 24 volts. In the implementation of FIG. 2, each of the first and second illumination control packets 200 can include an ASCII string that can be activated when the processor 40 receives a carriage return character. The scaling parameter can correspond to an illumination scaling greater than zero. The input 30 can optionally be a serial interface such as an RS-232 interface, or an RS-485 interface. Further, the input can be a wireless interface.

The first color control output can use pulse frequency modulation based on the first color level parameter and can use pulse width modulation based on the scaling parameter for pulse modulating the first signal, the second color control output can use pulse frequency modulation based on the second color level parameter and can use pulse width modulation based on the scaling parameter for pulse modulating the second signal, and the third color control output can use pulse frequency modulation based on the third color level parameter and can use pulse width modulation based on the scaling parameter for pulse modulating the third signal.

The illumination controller 10 can further include a fourth (or additional) color control output for pulse modulating a fourth signal that powers a fourth illumination level for a fourth color. The processor can control the fourth color control output in accordance with the fourth color level parameter associated with the first illumination control packet and the scale parameter. The fourth color control output can use pulse frequency modulation based on the fourth color level parameter and can use pulse width modulation based on the scaling parameter for pulse modulating the fourth signal. The fourth color can optionally be amber or some other color. The illumination controller 10 can further include first and second front panel buttons, B1 and B2. The processor can be configured with a pre-programmed illumination sequence 410 that is controlled using the first and second front panel buttons.

As shown in FIG. 3, implementations of the current subject matter can also include a method 300 for controlling at least one three-color LED module 20. In the method, a first illumination control packet having at least a first color level parameter, a second color level parameter, and a third color level parameter 200 is received (step 310). Also, a second illumination control packet having a scaling parameter is received (step 315). A processor controls a first color control output to pulse modulate a first signal that powers a first illumination level for a first color in accordance with the first color level parameter and the scaling parameter, controls a second color control output to pulse modulate a second signal that powers a second illumination level for a second color in accordance with the second color level parameter and the scaling parameter, and controls a third color control output to pulse modulate a third signal that powers a third illumination level for a third color in accordance with the third color level parameter and scaling parameter.

Implementations of the current subject matter can also include an apparatus 10 for controlling at least one three-color LED module. The apparatus includes means 30 for receiving a first illumination control packet having at least a first color level parameter, a second color level parameter, and a third color level parameter; means for receiving a second illumination control packet having a scaling parameter; means for controlling a first color control output to pulse modulate a first signal that powers a first illumination level for a first color in accordance with the first color level parameter and the scaling parameter; means for controlling a second color control output to pulse modulate a second signal that powers a second illumination level for a second color in accordance with the second color level parameter and the scaling parameter; and means for controlling a third color control output to pulse modulate a third signal that powers a third illumination level for a third color in accordance with the third color level parameter and scaling parameter.

Implementations of the current subject matter can also include a computer program product comprising computer readable medium 50 storing: code for causing a computer to receive a first illumination control packet having at least a first color level parameter, a second color level parameter, and a third color level parameter; code for causing a computer to receive a second illumination control packet having a scaling parameter; code for causing a computer to control a first color control output to pulse modulate a first signal that powers a first illumination level for a first color in accordance with the first color level parameter and the scaling parameter; code for causing a computer to control a second color control output to pulse modulate a second signal that powers a second illumination level for a second color in accordance with the second color level parameter and the scaling parameter; and code for causing a computer to control a third color control output to pulse modulate a third signal that powers a third illumination level for a third color in accordance with the third color level parameter and scaling parameter.

The illumination controller 10 can provide RGB LED color control for a single lighting zone in smaller to mid-sized architectural spaces. The controller and the LED module(s) 20 can form one addressable segment 100 of a plurality of individually addressable and controllable segments corresponding to respective lighting zones. The controller can control common anode RGB components with input voltages below approximately 24 volts (or it can alternatively control three (or optionally more or fewer) separate single color LED strings simultaneously). The illumination controller can utilize pulse frequency modulation (PFM) to create smooth color fades and a logarithmic algorithm for more accurate color matching of eight-bit (256 level) RGB values or the like. The unitary illumination control command 200 can include an address for the illumination controller.

Further, implementations of the current subject matter can also include an illumination controller for use with at least one three-color LED module. The illumination controller includes an input, a control output, and a processor. The command input receives at least one illumination control packet. The control output pulse modulates a signal that powers an illumination level. The processor controls the control output in accordance with an illumination level parameter associated with a first illumination control packet received at the input and a scale parameter associated with a second illumination control packet received at the input. The control output can use pulse frequency modulation based on the illumination level parameter and can use pulse width modulation based on the scaling parameter for modulating the signal.

The illumination controller can be wall mounted and can be installed in a standard single-gang electrical box (advantageously separate from any AC line voltage wiring) and can be manually operated with only two front panel buttons. A power supply is separate and should be specifically matched to the LED system being driven and can supply power to illumination controller 10 via PWR input 80.

The illumination controller 10 can include a 6-position screw terminal connector. Typical screw positions can be labeled $V_{in}$ (voltage in), GND, $V_{out}$ (voltage out), R (red), G (green), and B (blue). Multiple parallel LED components can be wired in the same terminal block as long as the voltage requirements are compatible. $V_{in}$ and GND can be for the DC input from the power supply and can typically be in a range of approximately 6 volt minimum to approximately 24 volt maximum matched to the LED system. $V_{out}$ can be for a common anode of the LED system.

The processor 40 can optionally be a configurable communications controller, such as for example part number SX28AC/SS-G (available from Parallax Inc. of Rocklin, Calif.). The control outputs can each be implemented using a power MOSFET, such as for example part number FDP7030BL (available from Fairchild Semiconductor of San Jose, Calif.).

In one example of a device having one or more features consistent with an implementation of the current subject matter, manual operation of an illumination controller 10 can be accomplished using two buttons, B1 and B2, and a predefined sequence of colors that will be displayed in a continuous loop (Loop Mode) at variable speeds. The sequence can be frozen (Freeze Mode) at any point in the loop. The buttons B1 and B2 can optionally be arranged such that B1 is a top button and B2 is a bottom button, for example in a face place that can be mounted in a single-gang electrical box for wall mounting. The B1 button can be used to toggle between a Loop Mode and a Freeze Mode. The B2 button can have different functions depending on the mode selected using the button B1. Upon power-up, the illumination controller can default to the Loop Mode with pre-defined fade and hold times.

In the Loop Mode, the B2 button can act as a time multiplier. For example, each time the B2 button is pressed (and released) in the Loop Mode, the fade times and hold times can be doubled until the multiplier is some upper threshold (for example 32× for a sequence of 2×, 4×, 8×, 16×, 32×). The multiplier can revert back to 1 on the next press and release of the B2 button. To get directly back to a multiplier of 1 from any given multiplier, the B2 button can be pressed and held for some threshold amount of time, for example two seconds, then release. At any time during the Loop Mode, a press and release of the B1 button can freeze the display (even in the middle of a color fade) and hold on that color indefinitely until another press of a button. While in the Freeze Mode, each press and release of the B2 button can skip to the next defined color and stay there indefinitely until another press of a button.

The Freeze Mode can be exited and returned to the Loop Mode, for example by pressing and releasing the B1 button. The loop can fade to the next color in the sequence and continue looping through the sequence with the time multiplier set before entering the Freeze Mode. After multiple button presses, to determine which settings are current, a press and release of the B2 button can indicate whether or not the illumination controller is in the Freeze Mode or the Loop Mode (the colors can change with each press and release in the Freeze Mode). If it is in the Loop Mode, pressing and holding the B2 button for some threshold amount of time, for example two seconds, and then releasing can cause a return to the default settings.

The fade time can be the time it takes to reach the defined color from the previous color (e.g. in seconds, for example from 1 to 60 seconds). The hold time can be the time the color stays static before the fade to the next color (e.g. 0.1 to 60 seconds). The fade and hold times can optionally be user-set to the shortest times that could be needed so that later adjustments can be via the multiplier as described above. In one example, times can be defined to the nearest tenth of a second (e.g. 6.7 seconds).

FIG. 4 illustrates a sequence 410 that can be stored as a table in the processor 40, or in a computer readable medium 50. Each step of the sequence can include a red level value 420, a green level value 430, a blue level value 440, a fade time value 450, and a hold time value 460. The RGB levels can correspond to a color description 470. The illumination controller can be extended to add control for a fourth color or other additional colors, such as for example amber, for a richer color selection. In such case, an amber level value can be added to the unitary illumination control command In a further aspect of the current subject matter one or more implementations can, among other possible advantages, provide a serial protocol (e.g. as described above), which can be used to transfer serial strings via an Ethernet packet to an Ethernet-enabled illumination control device, which is referred to herein as a networked lighting controller (NLC). Such a device can receive the Ethernet packet and transfer the communication string serially to one or more multichannel pulse frequency modulated (PFM) illumination control devices to adjust light intensity levels and fade rates at each channel. The Ethernet packet can differ from the serial packets described above, which can generally be a serial string.

In an implementation, delivered power from a power over Ethernet (PoE) switch can provide power to the LED lighting and control circuitry, such that both power and transmission and receiving of the serial command strings can be accomplished via Ethernet. PoE technology can enable the transfer of power in addition to data on Ethernet cabling, which can be advantageous relative to requiring separated electrical power and data wiring in that wiring requirements can be substantially reduced. For example, installation of a controlled lighting device can be accomplished without the need for an electrician and with reduced cabling or wiring during installation. Lighting devices consistent with implementations of the current subject matter can be delivered and configured as an IT service to a building.

Implementations of the current subject matter can also allow a building owner or administrator to monitor and control lighting power within the building as needed for occupants and policies, in addition to eliminating the use of such power when not necessary. This capability can, among other potential advantages, enable better optimization of lighting power utilization and thereby extend the life of light fixtures while reducing energy consumption.

Further variations of the current subject matter can optionally include a sensor for detecting occupancy or presence (ex: PIR), which can further optionally be combined with light level sensors (ex: ALS) to create a user defined, optionally policy driven lighting experience.

Implementations of the current subject matter can include single or multiple LED fixtures, which can optionally be installed as stand-alone or multiples in one or more daisy chains. This flexibility can enable use of the current subject matter as a viable solution for many lighting topologies and applications.

Figure 5:
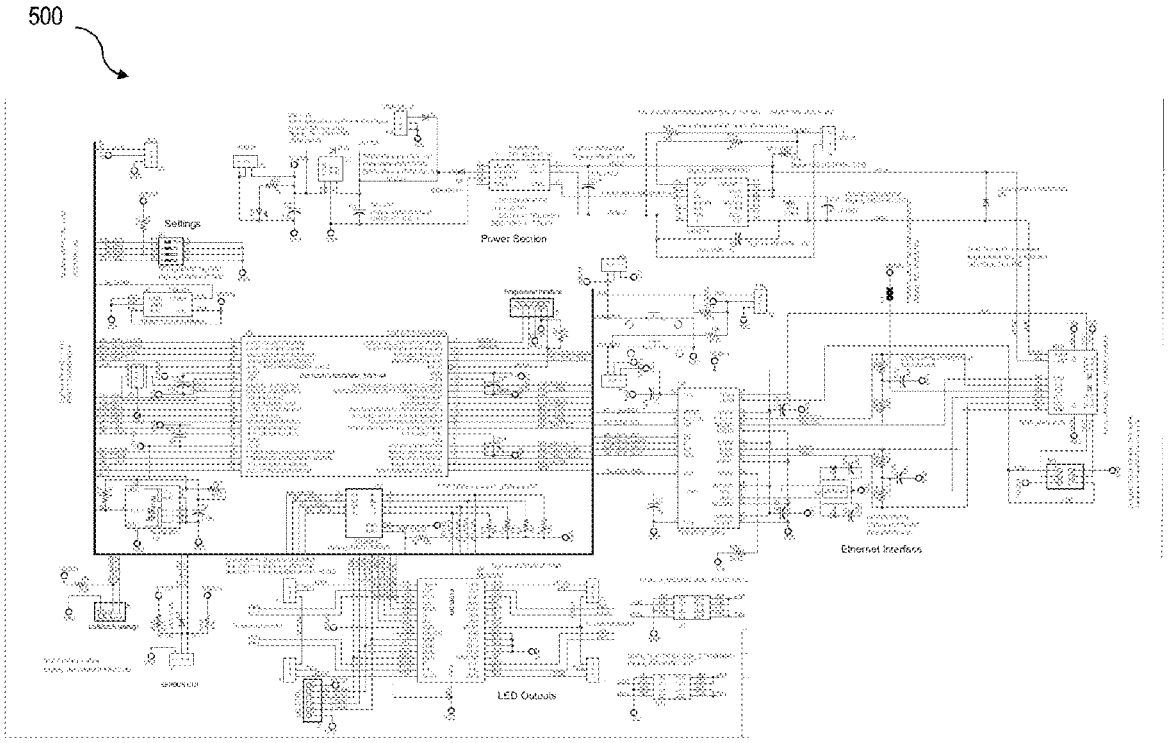
FIG. 5 is a circuit diagram illustrating features of a lighting controller consistent with implementations of the current subject matter.
Figure 6:
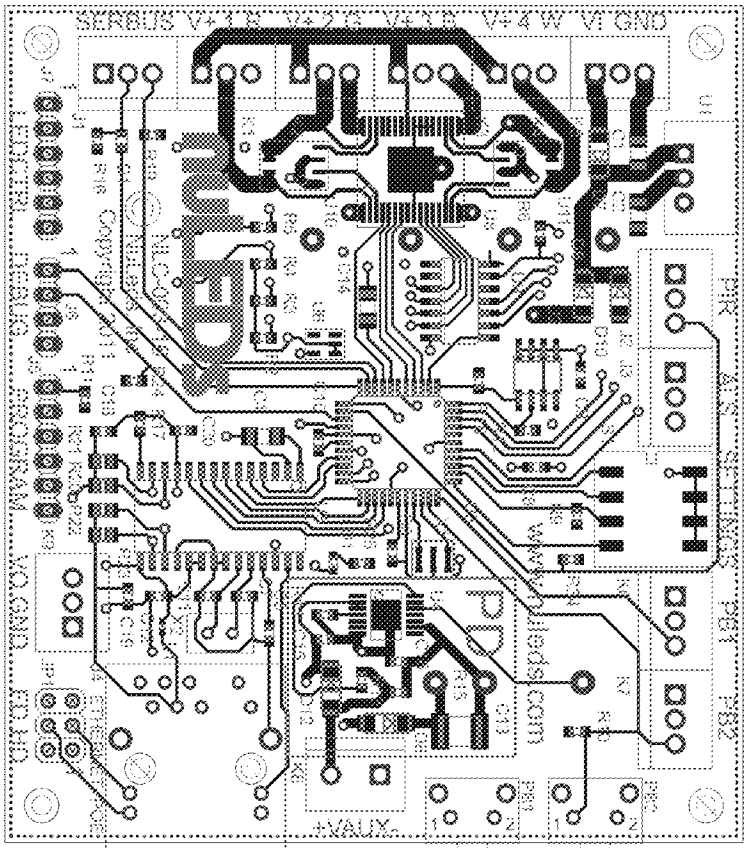
FIG. 6 is a diagram of a controller circuit board consistent with implementations of the current subject matter.

As illustrated in the wiring diagram 500 and the circuit board diagram 600 shown in FIG. 5 (and the corresponding magnified view in FIGS. 5A, 5B, 5C) and FIG. 6, a networked lighting controller (NLC) board consistent with implementations of the current subject matter can include one or more features, including but not limited to an RJ45 socket for a Category 5 cable (PoE input and/or output), which can also be referred to as a mag jack (magnetic jack) with integral inductors, diode bridges, and a sense resistor for detecting PoE; an integrated circuit (for example, part no. LM5073 available from Microchip Technology, Inc. of Chandler, Ariz.) for establishing connection to PoE and indicating that the light fixture is a PoE Powered Device (PD); a PHY/MAC integrated circuit (for example, part no. ENC28J60 available from Microchip Technology, Inc. of Chandler, Ariz.) that can, for example, contain a MAC address and handle the physical layer of the internet protocol and converts to a serial interface; a microcontroller, which can be implemented using a commercially available microcontroller chip including, for example, one or more of various dsPIC chips (for example those available from Microchip Technology, Inc. of Chandler, Ariz.) and the like for receiving serial data and processing into lighting control PFM outputs; one or more timing devices (resonator or oscillator) for synchronizing control signals; memory or other volatile or non-volatile storage for storing code and data; connections to a serial bus (SERBUS), molex, PIR, ALS, or other optional additional inputs for control or function(s); an optional heavy duty driver that is externally powered and receives its signals from the LED control connector and that can for example handle currents up to 60 amperes; a hex buffer/driver with open collector outputs that can be controlled by the microcontroller; one or more current control LED drivers that can be controlled by the microcontroller; a DCDC converter allowing power conversion to be regulated from PoE input power; one or more RS-485 inputs for controlling multiple boards or fixtures, which may also be daisy-chain linked by the SERBUS in and out connectors; one or more LED outputs with scaling, dipswitch and TTL (transistor-transistor logic) serial interface(s), and one or more I/O (input/output) pins for future enhancements; an auxiliary power input for non-PoE systems; and an auxiliary power output for powering other devices.

As noted, LED lights consistent with one or more implementations of the current subject matter can be powered with low voltage DC electrical power or PoE. Power can, in some implementations, be transmitted to the LED lights through RJ45 sockets, which support PoE. Non-PoE power can be delivered through other channels, for example via low-voltage electrical wiring. In implementations in which external (e.g. non-PoE) power is used, the RJ-45 jack can receive just the IP signal.

Consistent with implementations of the current subject matter, LED lighting parameters can be controlled using one or more approaches. For example, a serial protocol such as is discussed above can be used. Alternatively or in addition, a program or other software or software and hardware in combination executing on a general purpose or dedicated computing system that includes one or more programmable processors can serve as the controller.

Multiple LED channels can be controlled independently, for example as discussed above. Scaling of individual channels or the entire controller can be controlled by a single scaling parameter (allows for power utility demand response power reduction with no loss of functionality).

Computer software control of one or more features of the current subject matter can be achieved in a variety of ways. In one non-limiting example, one or more user datagram protocol (UDP) inputs can be provided for receiving data that is transmitted via category 5 Ethernet cable, which can enable communication with one or more computers, computer programs or other hosts over an Internet protocol (IP) network without requiring prior communications to set up special transmission channels or datapaths. In another example, a Transmission Control Protocol/Internet Protocol (TCP/IP) signal, packet, or the like can be transmitted, for example via a wired (e.g. over Ethernet) or wireless (e.g. one or more 802.11 and 802.15 protocols, Bluetooth, a cellular network, etc.) connection.

A user or administrator can be enabled to control light color and light intensity levels, enable color and intensity preferences, create & manage support schedules, and create & manage preset scene(s). Real time or stored data on the lighting fixture controls can also be transmitted or received by various computers, computer programs, management systems or control systems. This functionality can allow for greater portability and function with the user's existing systems thereby eliminating the need for wholesale changes or proprietary control system purchases.

Figure 7:
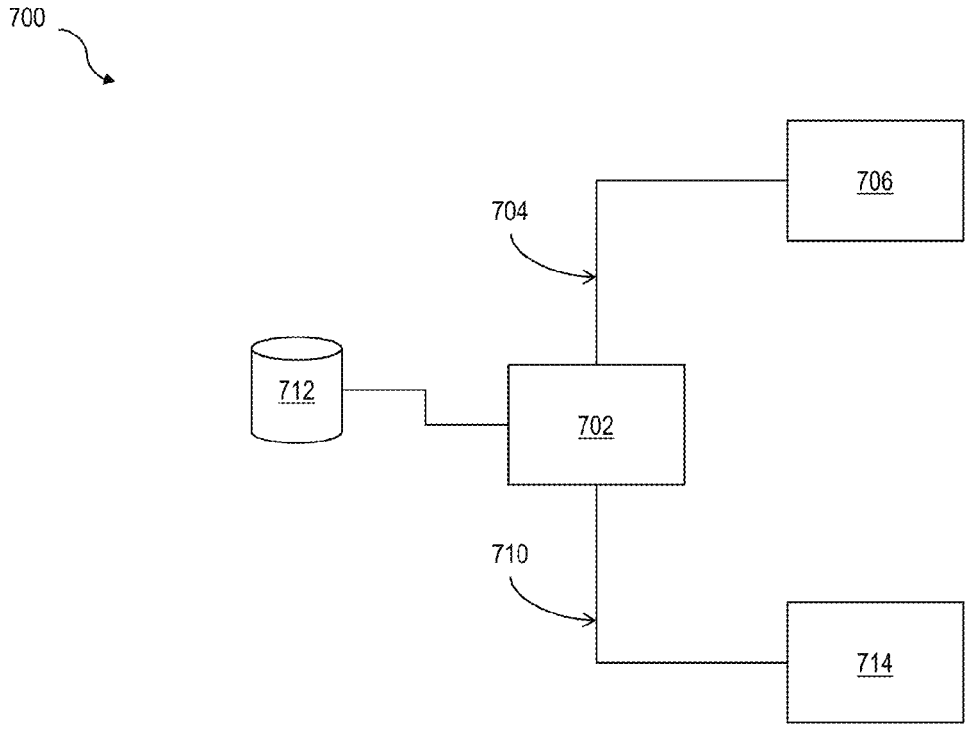
FIG. 7 is a diagram showing an example system in which lighting control is provided via Ethernet network wiring and power is supplied by low voltage wiring.
Figure 8:
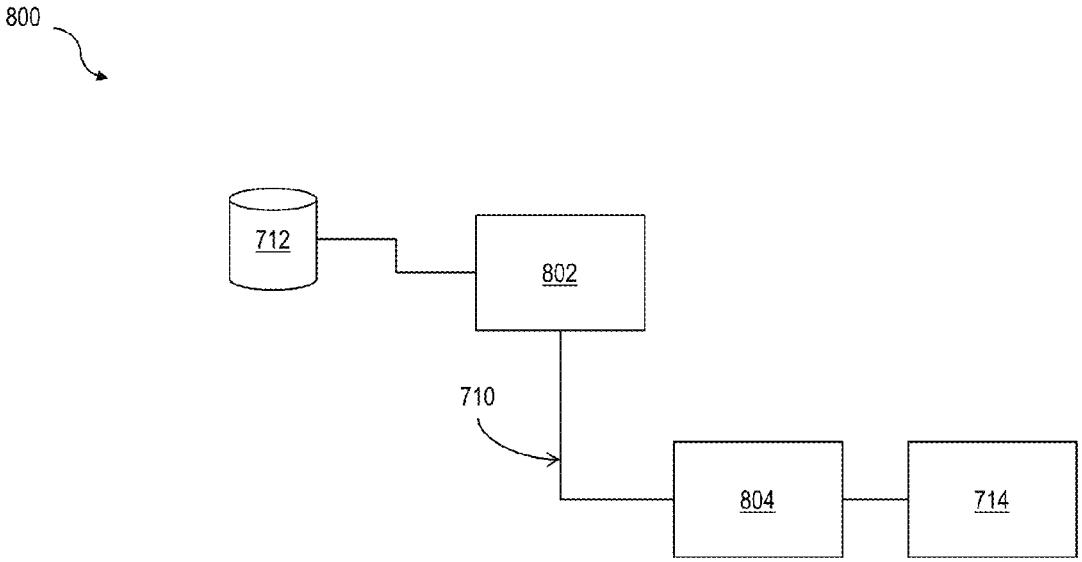
FIG. 8 is a diagram showing an example system in which lighting control and power are provided via Ethernet wiring.

FIG. 7 shows a diagram of a system 700 in which power is supplied to a lighting controller 702 via low voltage wiring 704 from a low voltage power supply 706. Lighting control (e.g. exchange of Ethernet control packets) can be provided to lighting controller 702 via one or more network connections including, for example, Ethernet cabling 710 to control operation of a LED fixture 712 according to commands from a computer or other data processing device 714. In some implementations, connection 710 may be a wireless connection as previously described. Computer/data processing device 714 can communicate with lighting controller 702 via a network that can support wired, and optionally, wireless features. FIG. 8 shows a diagram of a system 800 in which both power and lighting control (e.g. exchange of Ethernet control packets) are provided via Ethernet cabling 710 to a lighting controller 802 to control operation of a LED fixture 712 according to commands from a computer or other data processing device 714, which can communicate via a network that can support wired, and optionally, wireless features as well as a power over Ethernet power supplier component 804.

Figure 9:
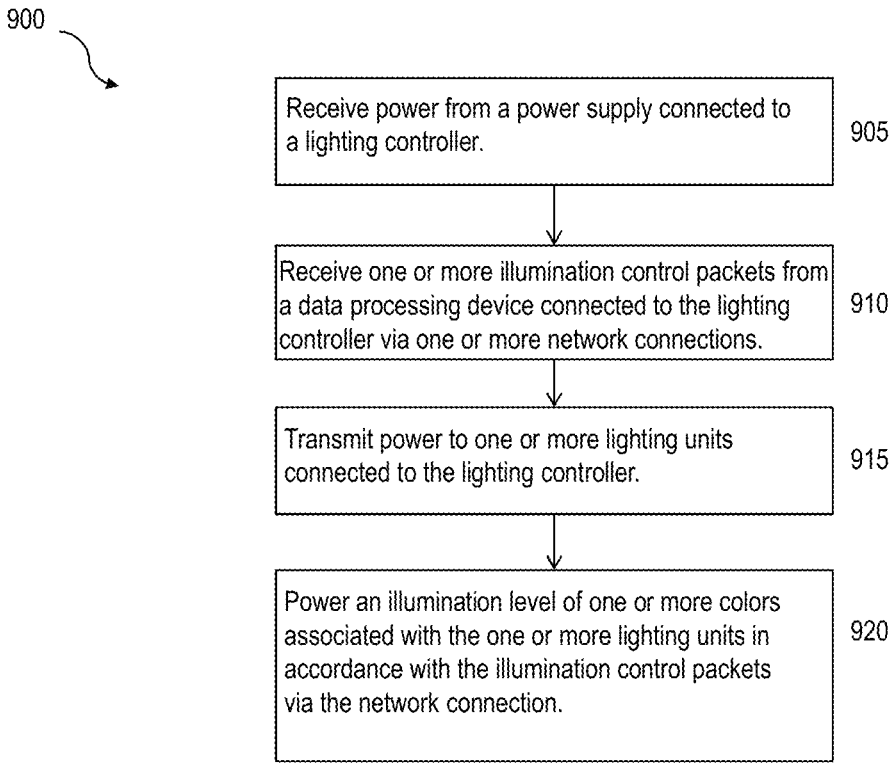
FIG. 9 is a flowchart for receiving and transmitting power and control to lighting units connected to a lighting controller.

FIG. 9 illustrates a flowchart for receiving and transmitting power and control to lighting units connected to a lighting controller. At 905, the lighting controller can receive power from a power supply connected to the lighting controller. In some implementations, the lighting controller can receive power via an Ethernet connection or low voltage wiring.

At 910, the network controller can receive one or more illumination control packets from a data processing device that is connected to the lighting controller. The data processing device may be connected to the lighting controller via one or more network connections. This data processing device can, for example, correspond to computer/data processing device 714 illustrated in FIGS. 7 and 8.

At 915, the network controller can transmit power to one or more lighting units connected to the lighting controller. In some implementations, power can be transmitted to these lighting units over an Ethernet connection or low voltage wiring.

At 920, the network controller can power an illumination level of one or more colors associated with the lighting units in accordance with the illumination control packets. This control may be performed over a network connection including, for example, Ethernet connection or a wireless connection.

As described herein, an illumination controller for use with at least one three-color LED module can include an input for receiving at least one illumination control packet via networked wiring, such as for example Ethernet wiring. The illumination control packet can include a first color control output for pulse modulating a first signal that powers a first illumination level for a first color, a second color control output for pulse modulating a second signal that powers a second illumination level for a second color, a third color control output for pulse modulating a third signal that powers a third illumination level for a third color. A processor included in the controller can control the first, second, and third color control outputs in accordance with the control packet, and optionally in accordance with a scale parameter that can be associated with a second illumination control packet received by the controller or that can be part of the illumination control packet. The control packets can be packets received by the processor over Ethernet wiring and then converted to serial packets distributed to one or more lighting fixtures, for example as described herein.

Each of the first color control output, the second color output, and the third color output can optionally use pulse frequency modulation based on the first, second, or third color level parameter, respectively and also pulse width modulation based on the scaling parameter for pulse modulating the first signal, the second signal, and the third signal, respectively. Each of the first and second illumination control packets can optionally include an ASCII string. The first, second, and third color control outputs can be controlled in response to receiving an illumination control packet including a carriage return character. The controller can optionally include a serial interface (e.g. a RS-232 interface, a RS-485 interface, etc.) for communicating with the at least one three-color LED module and a network interface (e.g. an RJ-45 connection for receiving the at least one illumination control packet via networked wiring. The at least one illumination control packet can optionally be received via a wireless connection.

Implementations of the current subject matter can include, but are not limited to, systems and methods consistent including one or more features are described as well as articles that comprise a tangibly embodied machine-readable medium operable to cause one or more machines (e.g., computers, etc.) to result in operations described herein. Similarly, computer systems are also described that may include one or more processors and one or more memories coupled to the one or more processors. A memory, which can include a computer-readable storage medium, may include, encode, store, or the like one or more programs that cause one or more processors to perform one or more of the operations described herein. Computer implemented methods consistent with one or more implementations of the current subject matter can be implemented by one or more data processors residing in a single computing system or multiple computing systems. Such multiple computing systems can be connected and can exchange data and/or commands or other instructions or the like via one or more connections, including but not limited to a connection over a network (e.g. the Internet, a wireless wide area network, a local area network, a wide area network, a wired network, or the like), via a direct connection between one or more of the multiple computing systems, etc.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural and/or object-oriented programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including, but not limited to, acoustic, speech, or tactile input. Other possible input devices include, but are not limited to, touch screens or other touch-sensitive devices such as single or multi-point resistive or capacitive trackpads, voice recognition hardware and software, optical scanners, optical pointers, digital image capture devices and associated interpretation software, and the like.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. An apparatus comprising:

a first input to receive power from a power supply;

a second input to receive one or more illumination control packets from a data processing device via one or more network connections; and an output to power an illumination level of a lighting unit, wherein the output adjusts the illumination level in accordance with an illumination level parameter and a fade time parameter received in an illumination control packet by the second input, and wherein the illumination control packet includes an address parameter for the second input.

2. The apparatus of claim 1, wherein the illumination level is further based on a scaling parameter received in the illumination control packet.

3. The apparatus of claim 2, further comprising a processor configured to control the illumination level associated with the lighting unit by pulse frequency modulating a signal in accordance with the illumination level parameter, and by pulse width modulating the signal based on the scaling parameter.

4. The apparatus of claim 1, wherein the power supply is a power over Ethernet device, wherein the first input receives power from the power supply via an Ethernet connection, and wherein the output transmits power to the lighting unit via another Ethernet connection.

5. The apparatus of claim 4, wherein the first input and the output is an RJ45 socket.

6. A method comprising:

receiving at a first input power from a power supply;

receiving at a second input one or more illumination control packets from a data processing device via one or more network connections; and powering from an output an illumination level of a lighting unit, wherein the output adjusts the illumination level in accordance with an illumination level parameter and a fade time parameter received in an illumination control packet by the second input, and wherein the illumination control packet includes an address parameter for the second input.

7. The method of claim 6, wherein the illumination level is further based on a scaling parameter received in the illumination control packet.

8. The method of claim 7, further comprising controlling the illumination level associated with the lighting unit by pulse frequency modulating a signal in accordance with the illumination level parameter, and by pulse width modulating the signal based on the scaling parameter.

9. The method of claim 6, wherein the power supply is a power over Ethernet device, wherein power is received at the first input from the power supply via an Ethernet connection, and wherein power is transmitted from the output to the lighting unit via another Ethernet connection.

10. The method of claim 9, wherein the first input and the output is an RJ45 socket.

11. A non-transitory computer-readable medium containing instructions to configure a processor to perform operations comprising:

receiving at a first input power from a power supply;

receiving at a second input one or more illumination control packets from a data processing device via one or more network connections; and powering from an output an illumination level of a lighting unit, wherein the output adjusts the illumination level in accordance with an illumination level parameter and a fade time parameter received in an illumination control packet by the second input, and wherein the illumination control packet includes an address parameter for the second input.

12. The non-transitory computer-readable medium of claim 11, wherein the illumination level is further based on a scaling parameter received in the illumination control packet.

13. The non-transitory computer-readable medium of claim 12, the operations further comprising controlling the illumination level associated with the lighting unit by pulse frequency modulating a signal in accordance with the illumination level parameter, and by pulse width modulating the signal based on the scaling parameter.

14. The non-transitory computer-readable medium of claim 11, wherein the power supply is a power over Ethernet device, wherein power is received at the first input from the power supply via an Ethernet connection, and wherein power is transmitted from the output to the lighting unit via another Ethernet connection.

15. The non-transitory computer-readable medium of claim 14, wherein the first input and the output is an RJ45 socket.

16. The non-transitory computer-readable medium of claim 11, wherein the second input receives the illumination control packet via an Ethernet connection.

17. The apparatus of claim 1, wherein the second input receives the illumination control packet via an Ethernet connection.

18. The method of claim 6, wherein the second input receives the illumination control packet via an Ethernet connection.

* * * * *